United States Patent [19]

Odenthal

[11] Patent Number: 4,676,050

[45] Date of Patent: Jun. 30, 1987

[54] METHOD AND APPARATUS FOR TRANSPORTING FLEXIBLE PACKAGES, PARTICULARLY FLAT BAGS, FILLED WITH POURABLE OR FLOWABLE MATERIAL TO CONTAINER FILLING STATIONS

[75] Inventor: Heinz F. Odenthal, Zülpich, Fed. Rep. of Germany

[73] Assignee: OSTMA Maschinenbau GmbH, Zülpich, Fed. Rep. of Germany

[21] Appl. No.: 704,191

[22] Filed: Feb. 22, 1985

[30] Foreign Application Priority Data

Feb. 25, 1984 [DE] Fed. Rep. of Germany ..... 3406858
Jan. 18, 1985 [EP] European Pat. Off. ..... 85100475.4

[51] Int. Cl.[4] ..... B65B 35/50; B65B 11/58

[52] U.S. Cl. ..... 53/447; 53/449; 53/542; 53/171; 53/244

[58] Field of Search ..... 53/244, 250, 473, 475, 53/542, 534, 447, 449, 171; 271/200, 202, 214

[56] References Cited

U.S. PATENT DOCUMENTS

| | | | |
|---|---|---|---|
| 2,261,972 | 11/1941 | Matthews | 271/202 |
| 2,925,167 | 2/1960 | Lindberg | 198/462 |
| 3,095,960 | 7/1963 | Loginbuhl | 198/462 |
| 3,479,795 | 11/1969 | Martin | 53/250 |
| 3,932,982 | 1/1976 | Klapp | 271/184 |
| 4,124,967 | 11/1978 | Beer et al. | 53/250 |
| 4,161,092 | 7/1979 | Buday et al. | 53/244 |
| 4,161,095 | 7/1979 | Buday | 53/542 |
| 4,237,677 | 12/1980 | Klapp | 53/534 |
| 4,241,559 | 12/1980 | Klapp | 53/244 |

FOREIGN PATENT DOCUMENTS

| | | | |
|---|---|---|---|
| 907094 | 10/1962 | United Kingdom | 53/154 |

*Primary Examiner*—Robert L. Spruill
*Assistant Examiner*—Donald R. Studebaker
*Attorney, Agent, or Firm*—Howard M. Ellis; Michael L. Dunn

[57] ABSTRACT

The invention relates to a method of and an apparatus for transporting flexible foil packages, particularly flat bags (6, 8, 13) filled with unstabilized material to a package container (1). The flat bags (6, 8, 13) deposited flat and with uniformly distributed contents by a filling and closing machine upon a transport belt are first of all imbricated and maintained clamped on both sides during further transport into the package container, so that the uniform distribution of the contents is maintained into the container. A close filling of the container (1) without excessive pressure is ensured by this means. Because the flat bags are conveyed from the conveying path directly into the container without an intermediate magazine, containers of different size can be filled consecutively virtually without interrupting the conveyance. It is therefore possible, in the case of parallel operation of a plurality of similar lines, to operate filling machines of different capacity each at maximum capacity, in order to assembly containers which are filled with the flat bags delivered by the different filling machines into larger assorted units, without the different capacity leading to an excess supply of containers at the collecting station, where the containers are assembled to form the units. The surplus capacity of one or the other machine is in fact compensated by locking in other package containers into the one line and subsequently withdrawing the filled containers.

19 Claims, 2 Drawing Figures

METHOD AND APPARATUS FOR TRANSPORTING FLEXIBLE PACKAGES, PARTICULARLY FLAT BAGS, FILLED WITH POURABLE OR FLOWABLE MATERIAL TO CONTAINER FILLING STATIONS

BACKGROUND OF THE INVENTION

1. Field of the Invention

The invention relates to a method of transporting flexible foil packages, particularly flat bags, filled with unstabilised, particularly pourable or flowable material, to a package container forming a stacking station, whereby the bags arriving flat in a consecutive row and containing the contents in a distributed manner are transported from a horizontal conveying path section via an arcuate conveying path section to a final vertical conveying path section extending to the stacking station, upon which the bags are retained clamped on both sides during the transport.

2. Discussion of Prior Art

In order to accommodate flexible foil packages, particularly flat bags, filled with unstabilised material, particularly pourable or flowable material, as closely as possible in package containers, cases for example, but without excessive pressure on the contents, (risk of damage to the contents, soups or fragile chips for example), the material present on one side in the bag after the filling operation and closure is distributed uniformly over the entire bag by agitation, so that the bag transported flat along the first horizontal conveying path section has only a comparatively low height. The flat bags with the contents thus distributed, on their further conveying route, after passing an arcuate sloping conveying path, enter the final almost vertical conveying path section, in which they are retained clamped by conveyor belts arranged oppositely. These conveyor belts end above a magazine divided into compartments, in which magazine the bags are mutually aligned. As long as the bags are retained clamped between the conveyor belts on both sides, the uniform distribution of the contents is maintained. However, after leaving the conveyor belts the bag contents can shift towards the lower edge of the bag again. This shifting is further promoted by the fact that the bags strike the floor of the magazine at unreduced conveying speed, so that the contents also accumulate at the lower edge of the bag for this reason. Due to this one-sided shifting of the contents, the compact filling of the package container with such bags is not ensured, or the bags are pressed too hard, which leads to damage to the contents. Furthermore, the bags are shock-stressed again after the transfer of the bags present in the magazine into the package container. Furthermore, the preliminary sorting in a magazine and the transfer into the package container restrict capacity. Lastly, this preliminary storing of the bags is restricted to a specific size of the package container. A particular preliminary magazine has to be made available for each container size.

SUMMARY OF THE INVENTION

The underlying object of the invention is to develop a method of transporting flexible foil packages filled with unstabilised material to a package container, which permits a close packing of the foil packages without excessive pressure upon the contents. The filling of the package containers should then be possible without maltreating the contents but with a higher capacity than hitherto.

This object is achieved according to the invention in that after the distribution of the contents in the package and before the conveying path section leading from the horizontal into the vertical, the packages are imbricated, and in the package container each package is guided on its side facing the package stack by the packages already forming the stack and is exposed to forces of conveying effect on its side remote from the stack.

In the invention the imbrication of the packages has the dual effect that firstly the transport speed is decreased without reducing capacity, and the shock forces at the end of the conveying path are also reduced, and on the other hand the foil packages guide themselves in the package container. Any intermediate sorting in a magazine is therefore eliminated.

Whereas in the known methods the packages are thrown against the container bottom at indefinite speed, whilst they have no front or rear guidance, in the invention they are transported at a precise conveying speed to the bottom of the container, whilst they are braced at both their front and rear sides, so that the material distributed uniformly in the package cannot shift to one side. In this manner a close filling of the package container with packages is ensured, without the contents of the packages being thereby exposed to undue compressive stresses.

A favourable effect is produced upon the operation of filling the package container with packages if the container is advanced solely by the packages conveyed into the container. In this case the container should be capable of being slid upon a stationary base. In such a case the weight of the container becomes greater, and the dynamic pressure correspondingly greater, with increasing filling. This is favourable because when only a few packages have been filled into the package container the dynamic pressure should be as weak as possible, because otherwise there is a danger of the individual container being compressed unduly and the contents might then be damaged. However, when there are a large number of packages in the container a large elastic cushion is present which compensates for any excessive compression to an individual foil package.

It occurs frequently in practice that foil packages are filled with different contents and/or that foil packages of different dimensions are filled, and that package units (assortments) are assembled from such filled foil packages. The assembly is effected from a plurality of containers with the same dimensions, which are filled with foil packages of different contents and/or of different dimensions from container to container. However, the parallel operation of different filling and closing machines and packaging machines for the foil packages with different contents and/or different dimensions is not immediately possible for various reasons. The filling and closing machines generally operate with a different capacity. This means that the filling time into containers of the same size is different for the foil packages delivered by the various filling and closing machines. The output of filled containers may also be dictated by a machine stoppage due to a fault or to a change of foils. Lastly, a different filling time for the containers may also be dictated by the contents or by different dimensions of the packages. In order to prevent an excessive over-supply of the containers with packages one or the other type during assembly, the high-output machine may be adapted to the lowest-output machine by throttling. However, this type of adaptation leads to a reduction in capacity in the overall performance of the filling and closing machines and packaging machines.

A further claim of the invention therefore is to assemble foil packages with different contents and/or different dimensions into assorted package units and at the same time to operate with maximum capacity on each line of the machines operating in parallel.

According to one development of the invention, this object is achieved in that package containers are filled with foil packages of different contents and/or different dimensions in a plurality of parallel lines, whilst empty package containers, which are moved selectively from one or the other transport path to the filling station, are fed to the filling stations via two transport paths each for one type of package container, and from each filling station the filled package containers of the one type are transported via a transport path to a collecting station, and the filled package containers of the other type are transported from all the filling stations via further transport paths to a common collecting station, where the package containers which contain the foil packages filled with different contents and/or of different dimensions are combined to form package units.

In the method according to the invention, the surplus capacity of the strongest line is moderated relative to the weaker lines in that a package container of the one type is locked in repeatedly and intermittently and filled with foil packages at the filling station and transported away again when a sufficient supply of filled package containers of the other type exists at the collecting station to assemble package units from them. The filling of package containers of different types with foil packages is possible virtually without interrupting the conveyance of the foil packages to the filling station, because the foil packages pass from the vertical conveying path directly into the containers and do not enter the package containers via an intermediate accumulator, such as a magazine. The method according to the invention therefore permits lines of different capacity to be coordinated without throttling the capacities of the stronger lines.

A suitable apparatus for performing the method, according to the invention, of transporting foil packages to a package container consists of a first conveying path section, oriented substantially horizontally, having supporting transport means for the foil packages arriving flat in a consecutive row and filled with unstabilised, particularly pourable or flowable, uniformly distributed material, and of a further conveying path section extending from the horizontal arcuately into the vertical to the stacking station and having transport means clamping the foil packages on both sides. According to the invention, this apparatus is characterised in that a second conveying path section for imbricating the foil packages is arranged between the first and the further conveying path section, and that of the transport means clamping the foil packages, only one transport means extends above the stack to be formed in the container.

According to one development of the invention, that part of the transport means extending above the stack to be formed forms an abutment rigid in the direction of the stack axis, with which the pillar formed by the wall of the package container slidable on a base and receding with increasing stack height is associated on the opposite side of the stack. The weight of the package container increasing with progressive filling permits a very easy escape of the container at the start of the filling, so that there is no undue pressure upon an individual flat bag, with resulting damage to its contents, whereas as filling progresses the container is slid less easily. In this case however a compensation occurs via the elastic cushion formed by the foil packages, and growing larger with increasing stack height.

According to one development of the invention, a continuous flexible belt maintained under tensile stress passing over return elements only at the start and end of the conveying path section, which adapts itself between the return elements to the course of the rigid guide means and to the foil package to be transported via the latter is arranged on the outside of the arc of the conveying path section leading from the horizontal into the vertical.

The transition from the filling of one package container to the next empty package container is effected by creating a gap at the transition from the conveying path with the individually conveyed foil packages to the conveying path where the imbrication occurs, by faster or slower conveyance. As soon as the gap reaches the package container, it is possible to replace the full package container by an empty package container. This may be effected, for example, in that that end of the transport means extending above the stacking station is retracted in the direction of travel of the belt and then advanced again at the new container. This mode of transition is necessary if the package container can be slid only in the plane of its standing surface. However, if the package container is raisable and lowerable, then this mode of transition is not necessary. If the lower end of the transport means is nevertheless even then still adjustable in the direction of travel of the belt, then this is only to permit an adaptation to package containers of different height to be performed.

The belt should travel through a belt accumulator in order to maintain the belt tension. The belt accumulator then compensates the different belt lengths in the region of the arcuate guide means which result from the adjustment of the part extending above the stacking station or by different charging heights of the arcuate conveyor belt section.

Another subject of the invention is a machine for assembling a plurality of package containers filled with foil packages, which consists of a plurality of apparatuses of the abovementioned type for transporting foil packages into package containers, arranged mutually parallel. This machine is characterised in that two transporters for different empty package containers lead to each support located beneath the vertical conveying path section for the package containers to be filled with foil packages, that transfer elements for the selective transfer of a package container from one or the other transporter onto the support are provided, and that from each support a transporter for the filled package containers of the one type leads to a collecting station and a second transporter for filled package containers of the other type to a collecting station common to all the second transporters, whilst a distributor is associated with the support for the selective charging of at least one of the transporters with filled packages.

In such a machine, the apparatus for transporting foil packages to the empty package containers can be charged with a different capacity by the preceding filling and closing machines. The adaptation of the capacity is effected in that some of the foil packages in the highest-capacity line on the apparatus for packing the foil packages are filled into the package containers locked in only sporadically and branched out again, and not into the package containers which are transported to the common collecting station. It is therefore ensured, with the machine according to the invention, that the individual filling and closing machines for the flat bags can be operated at maximum capacity even when assembling package containers in which foil packages of different dimensions and/or with different contents are present.

DESCRIPTION OF AN EMBODIMENT OF THE INVENTION

Brief Description of the Drawing

The invention is explained more fully below with reference to a drawing illustrating an exemplary embodiment, in which in detail.

Detailed Description of the Embodiment of the Invention

Figure 1:
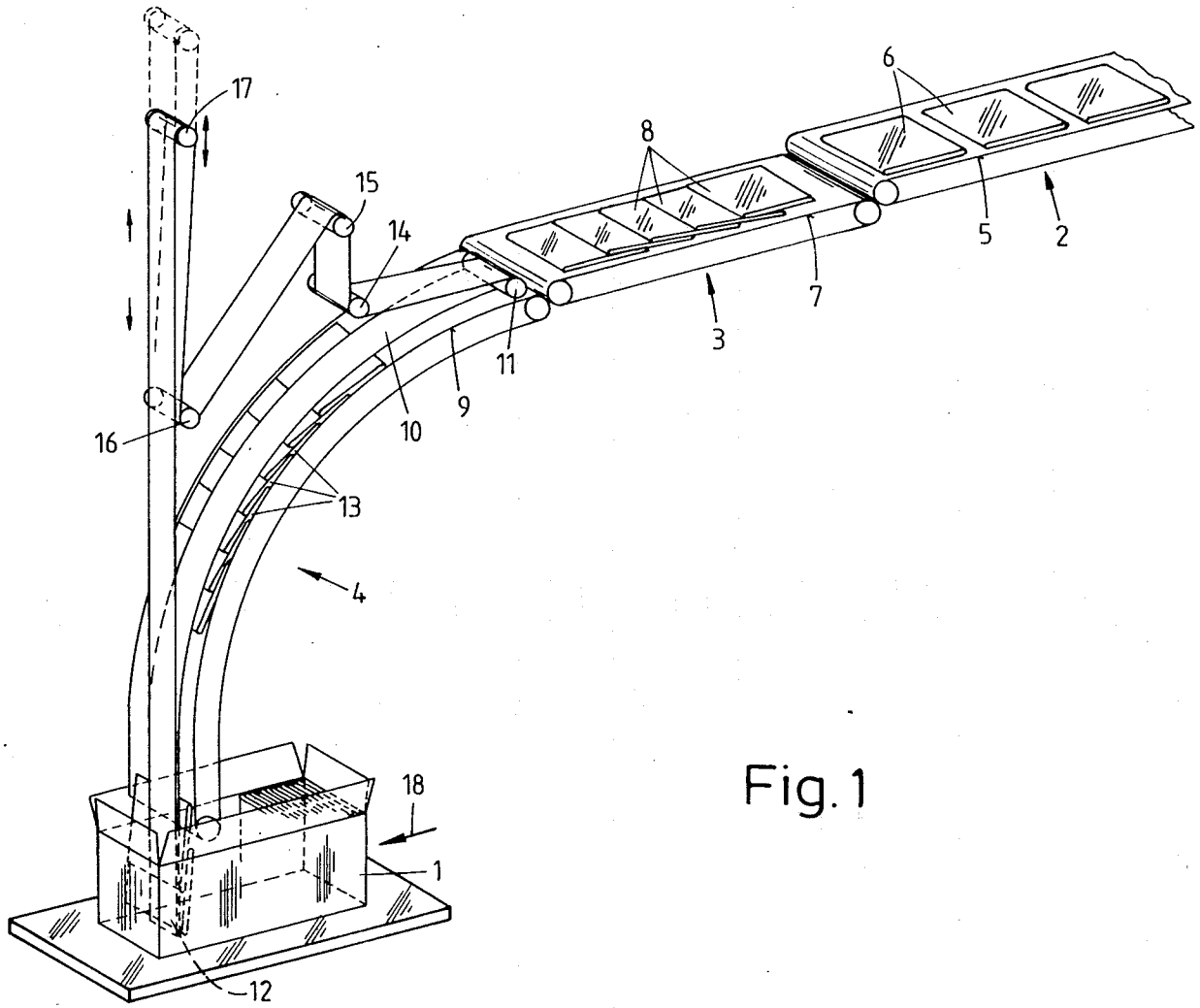
FIG. 1 shows an apparatus for transporting flexible foil packages, constructed as flat bags for example, which are delivered by a filling machine, not shown, into a package container in a perspective view

The apparatus according to FIG. 1 comprises three characteristic conveying path sections 2, 3, 4 between the filling and closing machine, not shown in FIG. 1, for filling the contents into flat bags, and the package container illustrated in the form of a parallelepipedic folding carton 1 open at the top. The conveying path section 2 is oriented horizontally and consists of a continuous conveyor belt 5, onto which the bags 6 filled by the filling and closing machine are deposited with uniformly distributed contents, flat and in a consecutive row. The conveyor belt 5 is adjoined in the second conveying path section 3 by a further conveyor belt 7, likewise horizontal but placed somewhat lower. This conveyor belt 7 has a slower transport speed than the conveyor belt 5. Due to the different conveying speeds of the two belts 2, 7, the flat bags 6 are imbricated at the transition point from the belt 5 onto the belt 7. A gap can be formed in the imbricated bag string 8 by a brief commutation to a higher speed.

The transport path section 4 leads from the horizontal into the vertical. It comprises a transport belt 9 arranged on the inside of the arc, which is guided invariably by a guide means, not shown. A second transport belt 10, which is provided on the outside of the arc, is passed at the start of the transport path section 4 over a return roller 11 adjustable in height relative to the transport belt 9, and at the end of the transport path section 4 over the stacking station 1, via a return element 12 not shown in detail, which has a lower height and is adjustable in the direction of travel of the belt. Between the return roller 11 and the return element 12 the belt receives its guidance by the belt 9 braced against baffle means and guide means, not shown, in that it is braced against this belt 9, the bags 13 conveyed in the conveying path section 4 being clamped. The belt 10 travels over further return rollers 14 to 17, of which the return roller 17 maintains the belt 10 under tension by means of a spring, not shown. The roller 17 forms the belt accumulator.

The end of the belt 10 extends into the carton 1. The carton 1 is influenced in the direction of the arrow 18 by a force, the frictional force of the carton 1 braced against a base, for example, which force however, admits a recession (sliding on the base) of the carton 1 counter to the direction of the force arrow.

The filling of the carton 1 occurs in the following manner:

The flat bags 6 arriving individually in a consecutive row and flat with uniformly distributed contents become imbricated at the transition onto the conveying path 3 due to the slower conveying speed, as already explained. The throughput capacity is not reduced by this means, but the transport speed is.

After a specific number of bags 6, which fit into a carton 1, for example, the belt 7 is accelerated so that the bag string 8 is separated from the next bag string by forming a gap. As soon as the bag string 8 enters the sloping conveying path section 4, the bags are clamped on both sides by the two belts 9, 10. By this means they acquire a definite conveying speed even on the sloping conveying path. It is also ensured by this means that the uniform distribution of the contents in the bags is maintained. Nor is this clamped state of the bags lost when the individual bag passes out of the region of influence of the belt 9, because in the case of the first bag the end wall of the carton 1 assumes the guidance, and then the further imbricated bags. Even after leaving the belt 9, the bags 13 are conveyed at a definite conveying speed, because they are subject to the influence of the second conveyor belt 10 until they reach their final position. Because the second conveyor belt 10 is braced unyieldingly, the bags conveyed into the carton 1 exert a pressure directed counter to the direction 18 of the force, so that the container is slid on its base counter to the force acting in the direction of the arrow 18 as the filling progresses. In the simplest case the carton may be deposited on a slideway, so that the pressure must be sufficient to set the carton 1 in motion. If the pressure is insufficient, or if the pressure would be too great for the contents, a force acting in the direction of movement may be exerted upon the container additionally.

As soon as the carton 1 has been filled with flat bags, the gap between two consecutive strings 8, 13 is utilised in order to withdraw the return element out of the carton 1 and to reintroduce it into the next container.

Figure 2:
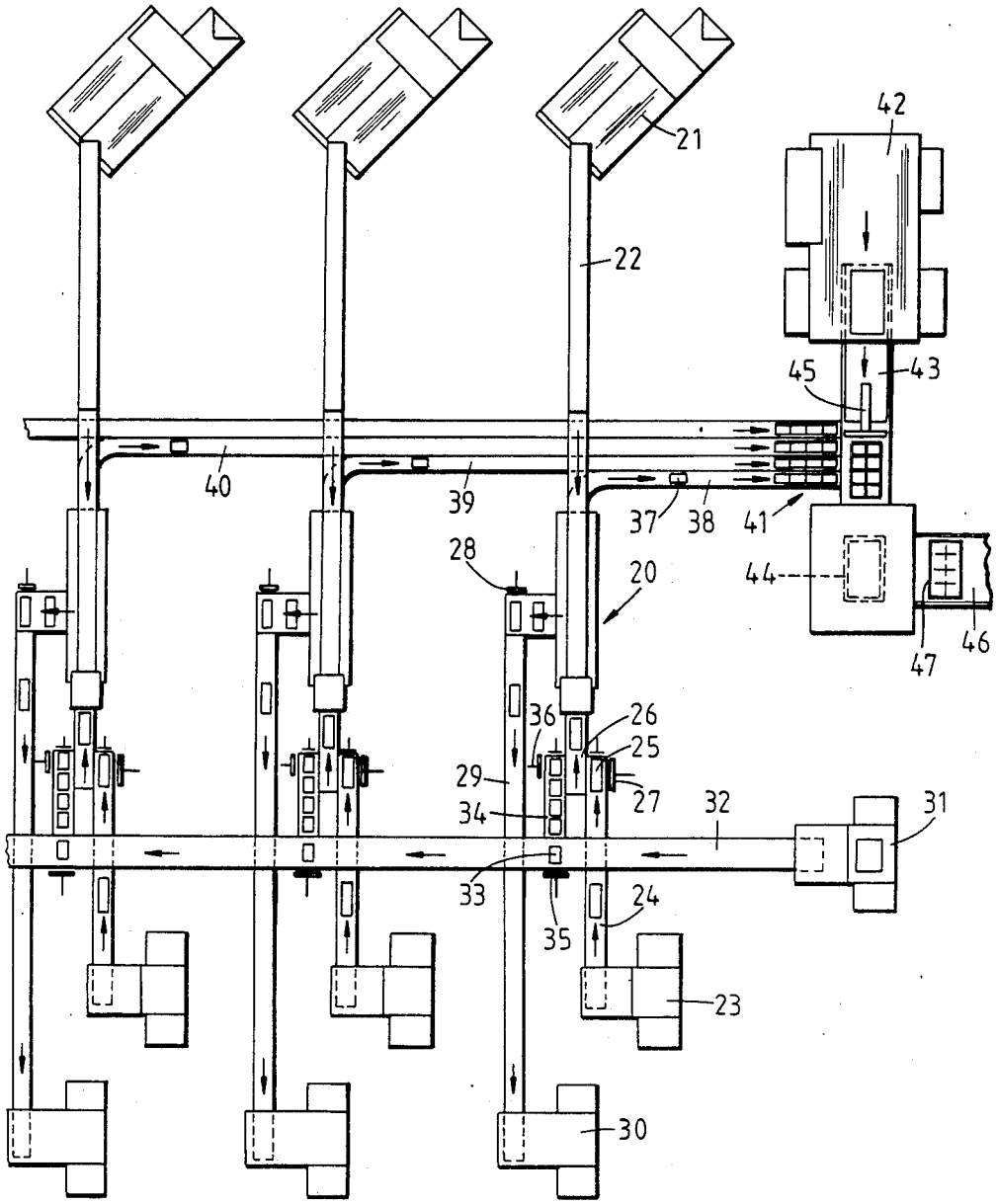
FIG. 2 shows a machine for assembling package containers, which have been filled with flat bags by means of apparatuses according to FIG. 1, at a common collecting station, in a diagrammatic view in plan.

In the case of the machine illustrated in FIG. 2, a plurality of similar apparatuses 20 of the type described in conjunction with FIG. 1 form mutually parallel lines, each together with a preceding filling and closing machine for the filling of contents into flat bags and subsequent closing of the flat bags. Different contents and/or differently dimensioned bags are processed on each line. Because all the lines have the same construction, the machine is described below solely using the example of one line.

The filling and closing machine 21 deposits the filled flat bags with uniformly distributed, but different contents upon a conveyor belt 22, which merges into the conveyor belt 2 of FIG. 1.

Two different types of package containers (cartons) can be fed to the apparatus 20. A conveyor belt 24 is charged with cartons 25 of the one type from a supply station 23. The conveyor belt 24 transports the cartons 25 to the side of a conveyor belt 26. The carton 25 can be transferred by means of a slider 27 onto the conveyor belt 26, which transports it into the filling position at the end of the arcuate conveying path 4. The carton filled with flat bags is conveyed to the side by means—slider et cetera—not shown in the drawing, from where it is transferred by means of a further slider 28 onto a transport belt 29 which transports the filled carton to a collecting station 30.

A belt 32 is charged with empty cartons 33 of the other type from a further supply station 31. From this belt 32, a belt 34 branches off for each apparatus 20. The carton 33 is transferred by a slider 35 onto this belt 34, which ends at the side of the belt 26. From here the carton is slid by means of a further slider 36 onto the belt 26, which transports it beneath the end of the arcuate conveying path 4. By the selective actuation of one or the other slider 27, 36, either the carton of the one type or of the other type can be fed to the apparatus 20.

Instead of the means constructed as sliders for transferring the cartons of one or the other type onto the conveyor belt, transfer means of a different nature may also be provided, points, for example, which connect the conveyor belt 26 with the transporter 24 or with the transporter 34. However, it is also possible for the one or other transporter to be arranged in a straight line to the conveyor belt 26. In this case, however, it is necessary to stop the feed of the cartons of the one type when it is required to transfer cartons of the other type onto the belt 26 and to feed them to the apparatus 20.

The carton 33 passes as a filled carton 37 onto a conveyor belt 38, which in conjunction with conveyor belts 39, 40 feeds the cartons coming from the similar apparatuses, which contain bars with different contents, to a collecting station 41. The cartons accumulate at this collecting station 41. A specific number of such cartons, eight cartons in the exemplary embodiment, form an assortment and are packed into a larger case which passes from a supply station 42 via a conveyor belt 43 beneath a shaft 44, through which the cartons forming an assortment, after being slid laterally by a slider 45, are filled into the case, which then leaves the filling station via a belt 46 as an assortment (campaign goods).

The accumulation of filled cartons 37 on the individual conveyor belts 38–40 may be monitored by supervising elements, not shown. If it is then ascertained than an excessively long accumulation is building up on one transport belt, the transfer devices 27, 36 for the cartons of different type may be commuted, namely so that the feed of cartons 31 of the one type is blocked and cartons 25 of the other type are locked into the apparatus 20, which are then fed not onto the conveyor belt 33 but onto the conveyor belt 29. Any excessive capacity in one line can be relieved by this means. By sporadically locking in a carton 25 into the one or other apparatus 20, all the lines can be operated at maximum capacity; nevertheless no excessive supply of cartons 27 occurs at the common collecting station. It is therefore possible, without interruption, to pack assortment goods (campaign goods) and individual goods simultaneously with the machine.

What is claimed is:

1. A method of filling and transporting containers with filled packages, which comprises the steps of providing flexible filled packages at a plurality of adjacent container filling stations by transporting said packages in a substantially horizontal path, contents of said packages being substantially uniformly distributed, transporting said filled packages further in a downward sloping path for depositing into containers while maintaining substantial distribution uniformity of said package contents, transporting empty containers of different dimensions for said filled packages to each container filling station from first and second empty container supply stations, filling the containers with the flexible packages while maintaining substantial distribution uniformity of package contents, transporting said containers filled with packages from the container filling stations to a common collecting station for filling further containers with said containers filled with packages from the adjacent container filling stations.

2. The method of claim 1 including the step of transporting containers filled with said packages at the adjacent filling stations to separate collecting stations to provide containers filled with packages having the same contents.

3. The method of claim 2 including the step of transporting the packages at the container filling station in a generally horizontal path wherein said packages are recumbent and overlapping one another.

4. The method of claim 3 wherein the flexible packages include bags which when filled remain in a substantially flattened condition.

5. The method of claim 3 including the step of imbricating the filled packages by conveying at a lower velocity than that of the filled packages.

6. The method of claim 3 including the step of depositing a first package in the container with a side of said first package facing an end wall of the container, and depositing further packages in said container in juxtaposition with one another and aligned with said first package to form a package stack.

7. The method of claim 6 including the step of advancing the container by depositing packages therein.

8. An apparatus for filling and transporting containers with filled packages, which comprises a plurality of adjacent container filling stations, said adjacent container filling stations comprising first conveying means for transporting the filled packages in a substantially horizontal path, the contents of said packages being substantially uniformly distributed, second conveying means for receiving filled packages from the first conveying means and for transporting said packages in a downward sloping path for depositing into containers, said second conveying means including means for maintaining substantial distribution uniformity of package contents, first and second empty container supply stations, independent conveying means for transporting containers of different dimensions from said first and second empty container supply stations to said adjacent container filling stations for filling with said filled packages while maintaining distribution uniformity of package contents, a common collecting station for the filled containers, third conveyor means for transporting filled containers from said adjacent container filling stations to said common collecting station, and means for filling further containers with said filled containers at said common collecting station.

9. The apparatus of claim 8 including separate conveyor means and collecting stations for transporting and receiving containers filled with said packages from the adjacent container filling stations.

10. The apparatus of claim 9 wherein the first conveying means includes means for overlapping the filled packages.

11. The apparatus of claim 10 wherein the first conveying means comprises multiple conveyor means for transporting flexible packages in a substantially horizontal path and means for imbricating said packages.

12. The apparatus of claim 11 wherein the second conveying means of said adjacent container filling stations includes means for clamping the flexible filled packages and retaining their imbricated arrangement as they are transported downwardly in a substantially vertical path.

13. The apparatus of claim 12 wherein the means for clamping the filled packages comprises opposing belt conveyors.

14. The apparatus of claim 12 wherein the second conveying means comprises an outer arcing transport belt and an opposing inner arcing transport belt, said outer belt including means for engaging and disengaging the opposing surface of the inner transport belt and means for raising and lowering to the interior of the container.

15. The apparatus of claim 14 wherein the means for engaging and disengaging the inner transport belt and for raising and lowering to the interior of the containers comprises upper and lower return elements and at least one idle pulley, the lower return element entering the container to provide a rigid abutment.

16. The apparatus of claim 12 wherein the second conveying means comprises an outer arcing transport belt and an opposing inner arcing transport belt supported by rigid guide means, the outer belt passing over a lower return element and an upper return element and adapting to the arcing configuration of the inner transport belt for compressing the packages, the outer transport belt being adjustable in the direction of travel of the belt.

17. The apparatus of claim 16 wherein the outer arcing transport belt travels over a belt accumulator.

18. The apparatus of claim 13 wherein the opposing belt conveyors have one conveyor extending downwardly further then the other, said downward extension being sufficient to enter the interior of the container.

19. The appartus of claim 18 wherein the downward extension of the conveyor in the container interior provides an abutment means for forming a package stack against an end wall of the container.

* * * * *